US007563084B2

(12) United States Patent
Kurita et al.

(10) Patent No.: US 7,563,084 B2
(45) Date of Patent: Jul. 21, 2009

(54) ROTARY FLUID MACHINE

(75) Inventors: Shin Kurita, Sakai (JP); Hiromichi Ueno, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 450 days.

(21) Appl. No.: 10/559,935

(22) PCT Filed: Jun. 10, 2004

(86) PCT No.: PCT/JP2004/008512

§ 371 (c)(1),
(2), (4) Date: Dec. 8, 2005

(87) PCT Pub. No.: WO2004/109113

PCT Pub. Date: Dec. 16, 2004

(65) Prior Publication Data

US 2006/0153723 A1 Jul. 13, 2006

(30) Foreign Application Priority Data

Jun. 10, 2003 (JP) ..... 2003-165131

(51) Int. Cl.
*F03C 2/00* (2006.01)

(52) U.S. Cl. ..... 418/29; 418/30; 418/60

(58) Field of Classification Search ..... 418/29, 418/30, 60

See application file for complete search history.

(56) References Cited

U.S. PATENT DOCUMENTS

| | | | | |
|---|---|---|---|---|
| 5,518,381 | A * | 5/1996 | Matsunaga et al. | 418/100 |
| 6,102,677 | A | 8/2000 | Iida et al. | |
| 2005/0191198 | A1 * | 9/2005 | Sato | 418/60 |

FOREIGN PATENT DOCUMENTS

| | | |
|---|---|---|
| CN | 1218143 | 6/1999 |
| JP | 57-176686 | 10/1982 |
| JP | 1-134092 | 5/1989 |
| JP | 08-165995 | 6/1996 |
| JP | 2000-87888 | 3/2000 |
| JP | 2000-234592 | 8/2000 |
| JP | 2001-99083 | 4/2001 |

* cited by examiner

*Primary Examiner*—Hoang M Nguyen
(74) *Attorney, Agent, or Firm*—Global IP Counselors

(57) ABSTRACT

A cylinder body is sandwiched between a front head and a rear head. A high pressure port is formed in the front head. A roller of a piston is configured such that top and bottom end surfaces thereof have different widths. The roller is arranged such that one of the top and bottom end surfaces having a larger width faces the front head 7.

4 Claims, 11 Drawing Sheets

(A)

(B)

SECTION ALONG A-A

"Prior Art"

FIG. 14 "Prior Art"
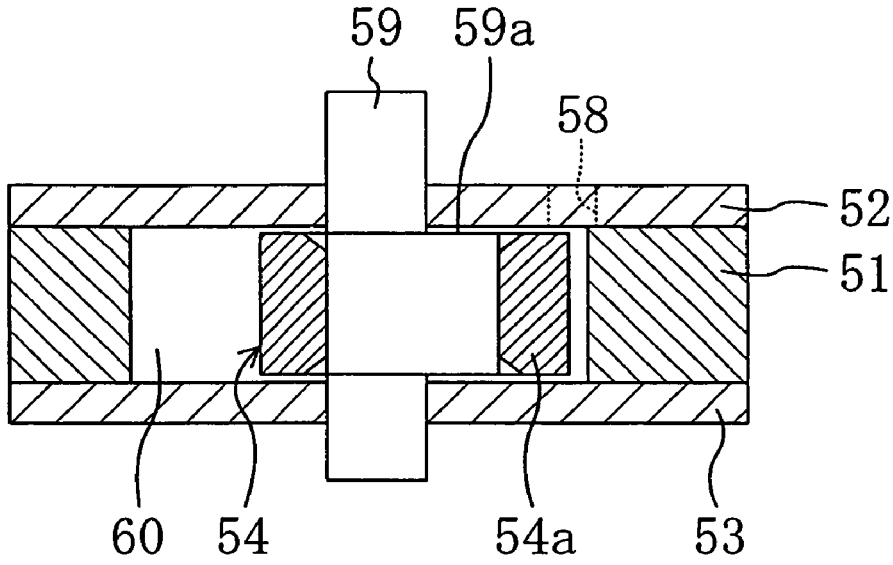
FIG. 15 "Prior Art"
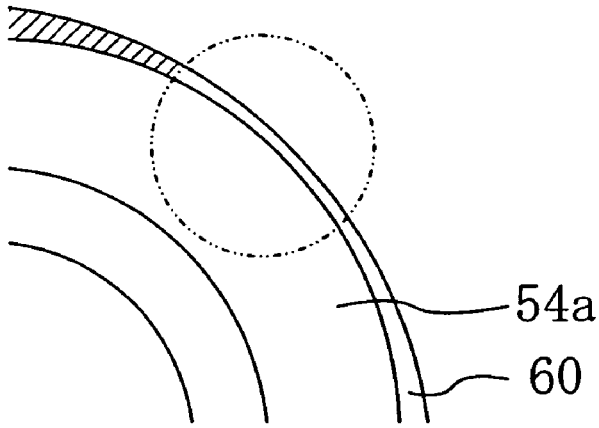

ROTARY FLUID MACHINE

CROSS-REFERENCE TO RELATED APPLICATIONS

This U.S. National stage application claims priority under 35 U.S.C. §119(a) to Japanese Patent Application No. 2003-165131, filed in Japan on Jun. 10, 2003, the entire contents of which are hereby incorporated herein by reference.

TECHNICAL FIELD

The present invention relates to a rotary fluid machine, in particular to measures for increasing efficiency thereof.

BACKGROUND ART

Japanese Unexamined Patent Publication No. 2000-234592 discloses an example of prior art relating to a rotary compressor used for refrigeration and air-conditioning. The rotary compressor includes, in a casing, a motor and a compressor element which receives torque of the motor via a crankshaft and compresses refrigerant gas. As shown in FIGS. 13 and 14, the compressor element is constructed of a tubular cylinder 51 whose ends are sealed by plates 52 and 53 and a piston 54 which is arranged in the tubular cylinder and includes an integral roller 54*a* and blade 54*b*. In the compressor element, a compression chamber 60 is defined by the cylinder 51, plates 52 and 53 and piston 54. The cylinder 51 is provided with a low pressure port 56 and the upper plate 52 is provided with a high pressure port 58. In response to the rotation of the crankshaft 59, the piston 54 swings in the cylinder 51. As a result, refrigerant gas sucked through the low pressure port 56 is compressed in the compression chamber 60 and the compressed refrigerant gas is discharged through the high pressure port 58.

Problem that the Invention is to Solve

In the above-described conventional rotary fluid machine, the end surfaces of the roller 54*a* of the piston 54 (top and bottom end surfaces in FIG. 14) have the same width as shown in FIG. 14.

Specifically, the roller 54*a* is fitted around an eccentric part 59*a* of the crankshaft 59. As the eccentric part 59*a* has high hardness, the length of a shaft hole in the roller 54*a* is shorter than the vertical length of the eccentric part 59*a*. Both ends of the shaft hole of the roller 54*a* are cut at a bevel, thereby defining the widths of the end surfaces of the roller 54*a*. Conventionally, the cut portions at the both ends of the roller 54 are formed the same, and therefore the both end surfaces have the same width.

Owing to this feature, there have been problems in that the degree of freedom in designing the high pressure port 58 or other is limited and compression efficiency may possibly decrease. Hereinafter, an explanation of a cause of the problems is provided.

There are several design limitations in order to maintain the compression efficiency, for example, limitations on the width in the diameter direction of the top and bottom end surfaces of the roller 54*a*, i.e., a difference between inner and outer diameters of the end surfaces, the degree of eccentricity, as well as the diameter and position of the high pressure port. Referring to FIGS. 13 and 14, the pressure in space along the inner periphery of the roller 54*a* is high due to the influence of oil discharged from an oil feeding path formed in the crankshaft 59, while the pressure in space along the outer periphery of the roller 54*a* (compression chamber 60) is low because the space is communicated with the low pressure port 56 for introducing gas. The high pressure port 58 is arranged to overlap the compression chamber 60 and not to face the space along the inner periphery of the roller 54*a*. Specifically, as shown in FIG. 13, irrespective of the position of the roller 54*a*, the diameter and the position of the high pressure port are defined such that the inner peripheral edge of the roller 54*a* at the top end surface does not overlap the high pressure port 58. Thus, the space along the inner periphery of the roller 54*a* and the space along the outer periphery of the roller 54*a* do not communicate with each other via the high pressure port 58.

When the roller 54*a* is shared among different kinds of compressors, it is assumed that the compressors may slightly be different in the diameters and positions of the high pressure ports. In such a case, even if one compressor does not make the internal and external spaces of the roller 54*a* communicate with each other, the other compressor may possibly achieve the communication when the same roller 54*a* is used. When the internal and external spaces of the roller 54*a* are communicated, oil discharged from the oil feeding path in the crankshaft 59 may flow into narrow space of the compression chamber (indicated as a shaded portion in FIG. 15) from the internal space of the roller 54*a* and the oil is compressed by the revolution of the roller 54*a*. Further, when the oil flows into the compression chamber 60, the sucked gas is heated. This may deteriorate the compression efficiency.

Further, if the diameter of the high pressure port is reduced to prevent the above-described communication between the internal and external spaces, flow resistance increases. As a result, pressure loss by the high pressure port 58 increases and excessive compression is likely to occur. Thus, there is a limit on the reduction of the diameter. Further, if the high pressure port 58 is positioned away from the cylinder center in order to prevent the communication, a portion of the high pressure port 58 which lies outside the compression chamber 60 increases in area, thereby decreasing an effective area of the high pressure port 58. In order to avoid the decrease, it is necessary to ensure the effective area of the high pressure port 58 by forming a recess in the inner peripheral surface of the cylinder 51 toward the outside to correspond to the misaligned portion of the high pressure port 58. By so doing, however, dead volume which does not contribute to the compression increases, thereby decreasing the compression efficiency.

Thus, even if the roller 54*a* is shared for the purpose of cost reduction, there is still a limit on the degree of freedom in designing the high pressure port 58. Therefore, keeping the efficiency high may possibly be affected.

In light of the above, the present invention has been achieved. An object of the present invention is to ensure the degree of design freedom and keep the efficiency high.

BRIEF SUMMARY OF THE INVENTION

In order to achieve the above-described object, according to the present invention, the roller 3 is arranged such that the end surfaces of the roller 3 are slidably in contact with the plates 7, 8 and 27 and one of the end surfaces having a larger width than the width of the other end surface faces the high pressure port 10.

Specifically, a first aspect of the present invention is directed to a rotary fluid machine including: a cylinder 1*c* having a cylinder body 2 and plates 7 and 8 arranged at both end surfaces of the cylinder body 2, one of the plates 7 and 8 having a high pressure port 10; and a roller 3 placed in the cylinder 1*c*, wherein the end surfaces of the roller 3 which are slidably in contact with the plates 7 and 8 of the cylinder 1*c* have different widths and the roller 3 is arranged such that one of the end surfaces having a larger width than the width of the other end surface faces the high pressure port 10.

According to a second aspect of the present invention relating to the first aspect of the present invention, the roller 3 is made of a sintered alloy.

According to a third aspect of the present invention relating to the first or second aspect of the present invention, the cylinder 1*c* includes two cylinder bodies 25 and 26. A partition plate 27 sandwiched between the cylinder bodies 25 and 26 and end plates 7 and 8 arranged outside the cylinder bodies 25 and 26 are provided as the plates. The roller 3 is arranged in each of the cylinder bodies 25 and 26 to have a difference in rotational phase. The end plates 7 and 8 are provided with high pressure ports 10, respectively. The end surfaces of each of the rollers 3 which are slidably in contact with the plates 7 or 8 and 27 of the cylinder 1*c* have different widths. Each of the rollers 3 is arranged such that one of the end surfaces having a larger width faces the end plate 7 or 8 and the other end surface having a smaller width faces the partition plate 27.

According to a fourth aspect of the present invention relating to the first or second aspect of the present invention, the cylinder 1*c* is arranged in an airtight container 9 and includes two cylinder bodies 25 and 26. A partition plate 27 sandwiched between the cylinder bodies 25 and 26 and end plates 7 and 8 arranged outside the cylinder bodies 25 and 26 are provided as the plates. The roller 3 is arranged in each of the cylinder bodies 25 and 26. The end plates 7 and 8 are provided with high pressure ports 10, respectively. The end surfaces of each of the rollers 3 which are slidably in contact with the plates 7 or 8 and 27 of the cylinder 1*c* are provided with cut portions 3*a* and 3*b*, respectively, such that one of the end surfaces facing the end plate 7 or 8 has a larger width than the width of the other end surface facing the partition plate 27. Gas discharged through the high pressure ports is temporarily retained in the airtight container 9.

Specifically, according to the first aspect of the present invention, the cylinder body 2 is sandwiched between the plates 7 and 8 and the roller 3 is placed in the cylinder body 2. The high pressure port 10 is formed in one of the plates 7 and 8. The end surfaces of the roller 3 which are slidably in contact with the plates 7 and 8 have different widths. The roller 3 is arranged such that one of the end surfaces having a larger width faces one of the plates 7 and 8 having the high pressure port 10 and the other end surface having a smaller width faces the other one of the plates 7 and 8. More specifically, the internal edge of the end surface of the roller 3 facing the high pressure port 10 is positioned more inside than the internal edge of the opposite end surface. Since the internal edge of the end surface of the roller 3 facing the high pressure port 10 is positioned more inside, even if the roller 3 is incorporated in a machine in which the high pressure port 10 is provided more inside, space along the inner periphery of the roller 3 and space along the outer periphery of the roller 3 are less likely to communicate with each other. Further, even if the roller 3 is incorporated in a compressor 1 having a larger high pressure port 10, the internal and external spaces of the roller 3 are less likely to communicate with each other because the internal edge of the end surface of the roller 3 facing the high pressure port 10 is positioned more inside.

According to the second aspect of the present invention, the roller 3 is made of a sintered alloy. The roller 3 made of a sintered alloy is obtained by pouring metal powder as a molding material into a mold, followed by pressing and sintering the metal powder. In the molding of the roller, the molding material is relatively stably pressed because pressure is applied to the end surface having a larger width (larger area). In this case, the molding material is relatively easily released from the mold because the end surface having a smaller width (smaller area) is the side to be detached from the mold.

According to the third aspect of the present invention, the rollers 3 revolve in the cylinder bodies 25 and 26 to have a difference in rotational phase. Therefore, torque fluctuations caused in the cylinder bodies 25 and 26 are canceled. When the rollers 3 have the difference in rotational phase, different pressure fluctuations are caused in the cylinder bodies 25 and 26. Therefore, the cylinder bodies 25 and 26 apply different pressures to the partition plate 27 arranged between the cylinder bodies 25 and 26 and the elastic deformation of the partition plate 27 is hard to reduce. In the present invention, however, since the rollers 3 are arranged such that their end surfaces having a smaller width face the partition plate 27, the rollers 3 are less influenced even if the partition plate 27 is elastically deformed. Therefore, the rollers 3 smoothly revolve in the cylinder bodies 25 and 26.

According to the fourth aspect of the present invention, gas discharged through the high pressure ports 10 is temporarily retained in the airtight container 9. Therefore, the airtight container 9 is at a high discharge pressure. The discharge pressure is applied to the end plates 7 and 8 arranged outside the cylinder bodies 25 and 26 such that the end plates 7 and 8 are warped toward the inside of the cylinder bodies 25 and 26. Each of the rollers 3 is arranged such that larger one of the cut portions 3*a* and 3*b* faces the partition plate 27. Since the influence of the oil is greater at the end surfaces having the larger cut portions 3*a* and 3*b* than at the end surfaces having the smaller cut portions 3*a* and 3*b*, the rollers 3 are pressed toward the end surfaces having the smaller cut portions 3*a* and 3*b*, i.e., toward the end plates 7 and 8. As a result, the rollers 3 suppress the warp of the end plates 7 and 8 toward the inside of the cylinder bodies 25 and 26.

Effect of the Invention

As described above, according to the first aspect of the present invention, the roller 3 is arranged such that one of the end surfaces having a larger width faces one of the plates 7 and 8 having the high pressure port 10 and the other end surface faces the other one of the plates 7 and 8. Therefore, the internal and external spaces of the roller 3 are less likely to communicate with each other. As a result, even if the roller 3 is shared, there is no need of taking measures of reducing the diameter of the high pressure port to avoid the communication. Thus, the diameter of the high pressure port is determined without limitations on the degree of freedom and an increase in pressure loss by the high pressure port 10 is prevented.

Further, as the need of taking measures of shifting the high pressure port 10 outside to avoid the communication is eliminated, the position of the high pressure port 10 is determined without limitations on the degree of freedom.

Further, since the portion of the high pressure port 10 lying outside the compression chamber 22 is reduced in area, even if a recess is formed in the inner peripheral surface of the cylinder 2 to ensure the effective area of the high pressure port 10, the size of the recess is kept small. Thus, dead volume which does not contribute to the compression is minimized.

Therefore, according to the present invention, the degree of design freedom is ensured, the increase in pressure loss is avoided and the dead volume is prevented from increasing as possible. Thus, the compression efficiency is maintained high.

According to the second aspect of the present invention, the roller 3 is made of a sintered alloy. In the molding of the roller 3, the molding material is relatively stably pressed because pressure is applied to the end surface having a larger width (larger area). In this case, the molding material is relatively easily released because the end surface having a smaller width (smaller area) is the side to be detached from the mold.

According to the third aspect of the present invention, the rollers 3 are arranged such that the rollers 3 have a difference in rotational phase and their end surfaces having a smaller width face the partition plate 27. Therefore, according to the present invention, torque fluctuations caused by the two cylinder bodies 25 and 26 included in the rotary fluid machine 1 are reduced and the influence by the elastic deformation of the partition plate 27 is also reduced. Thus, the rollers are operated with stability in the cylinder bodies 25 and 26.

According to the fourth aspect of the present invention, gas discharged through the high pressure ports 10 is temporarily retained in the airtight container 9 and the rollers 3 are arranged such that the end surfaces having the smaller cut portions face the end plates 7 and 8. Therefore, according to the present invention, leakage of the gas from the cylinder bodies 25 and 26 through gaps between the rollers 3 and the end plates 7 and 8 is suppressed.

BRIEF DESCRIPTION OF DRAWINGS

FIG. 14 is a view corresponding to FIG. 3 illustrating the conventional compressor.

FIG. 15 is a view illustrating a partial enlargement of FIG. 13.

DETAILED DESCRIPTION OF THE INVENTION

Hereinafter, a detailed explanation of embodiments of the present invention will be provided with reference to the drawings.

Embodiment 1

Figure 1:
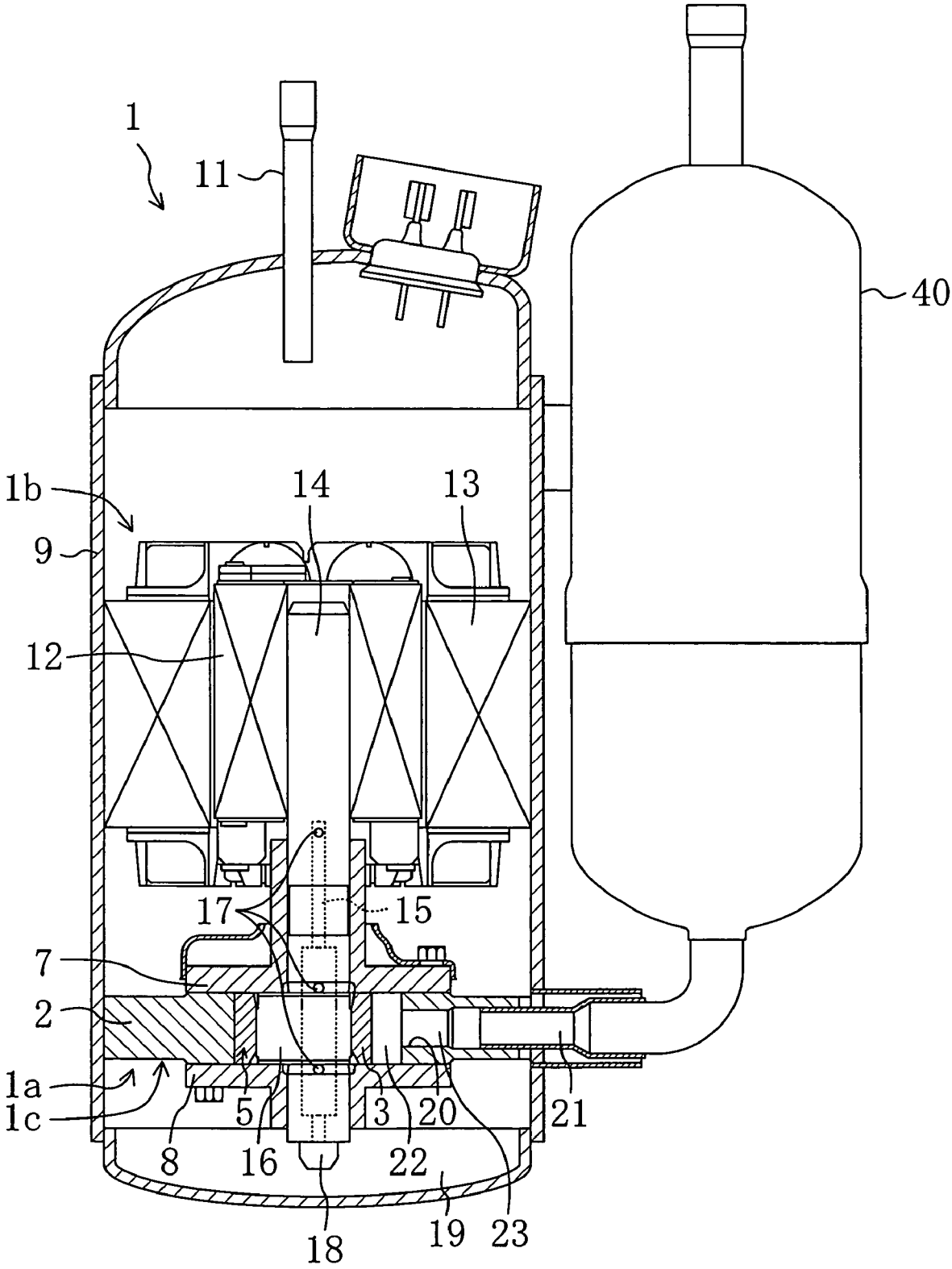
FIG. 1 is a sectional view illustrating the overall structure of a rotary fluid machine according to Embodiment 1 of the present invention.

As shown in FIG. 1, a rotary fluid machine according to Embodiment 1 of the present invention is constructed as, for example, a rotary compressor 1 which is incorporated in a refrigeration machine (not shown) and includes in an airtight container 9 a compressor mechanism 1*a* and a drive mechanism 1*b* for driving the compressor mechanism 1*a*.

Figure 2:
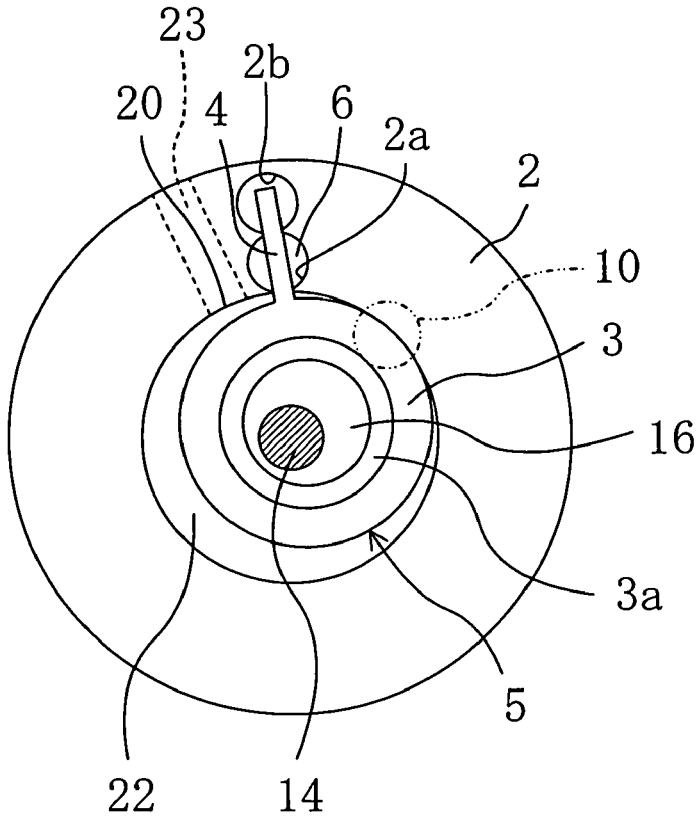
FIG. 2 is a top view illustrating a cylinder body and a piston according to Embodiment 1 of the present invention.
Figure 3:
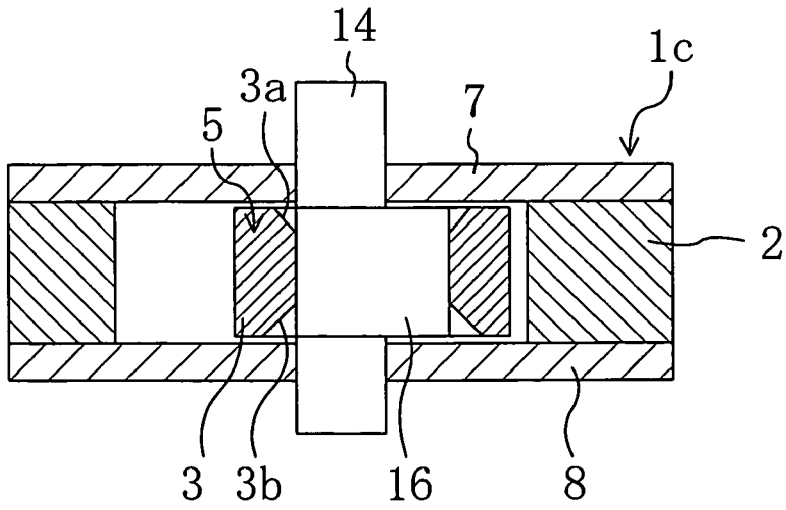
FIG. 3 is a sectional view schematically illustrating a major part of Embodiment 1 of the present invention.

As shown in FIGS. 2 and 3, the compressor mechanism 1*a* includes a cylinder 1*c* and a piston 5 arranged in the cylinder 1*c*. The cylinder 1*c* includes a tubular cylinder body 2 and a front head 7 and a rear head 6 as plates arranged on the top and bottom end surfaces of the cylinder body 2.

The piston 5 is arranged in the cylinder body 2 and formed by integrating a cylindrical roller 3 and a flat blade 4 extending outward in the radius direction from the roller 3. The piston 5 is made of a sintered alloy. Specifically, in Embodiment 1, the roller 3 and the blade 4 are made of the sintered alloy.

The outer periphery of the cylinder body 2 is fixed onto the inner periphery of the airtight container 9. The cylinder body 2 is provided with a bushing hole 2*a* formed to have an opening at the inner peripheral surface of the cylinder body 2 and a blade hole 2*b* continuous from the bushing hole 2*a*. A pair of bushings 6 are arranged in the bushing hole 2*a*. The bushings 6 are halves of a columnar component and rotatably fitted in the bushing hole 2*a*. The blade 4 is slidably inserted between the bushings 6.

The front head 7 and the rear head 8 are fixed together with bolts with the cylinder body 2 sandwiched therebetween. As a result, closed space 22 is defined by the front head 7, rear head 8, roller 3 and cylinder body 2. The closed space is a compression chamber 22. The compression chamber 22 is divided by the blade 4 into a high pressure chamber 22*a* communicated with a high pressure port 10 and a low pressure chamber 22*b* communicated with a low pressure port 23 to be described later.

The front head 7 is positioned higher than the rear head 8. The front head 7 is provided with a high pressure port 10 which extends in the vertical direction to communicate with the compression chamber 22 and the airtight container 9 under a certain pressure condition. A discharge valve (not shown) is provided at the top end of the high pressure port 10. The discharge valve is opened when the pressure in the cylinder body 2 exceeds the pressure in the airtight container 9, i.e., the pressure around the compressor mechanism 1*a*. At the top end of the airtight container 9, a discharge pipe 11 is inserted. Specifically, the rotary compressor 1 according to Embodiment 1 is constructed as a so-called high pressure dome compressor in which refrigerant gas discharged from the compressor mechanism 1*a* through the high pressure port 10 is temporarily retained in the airtight container 9.

The cylinder body 2 is provided with a low pressure port 23 which is formed to penetrate the cylinder body 2 in the radius direction. A suction pipe 21 penetrating the airtight container 9 is inserted into the low pressure port 23 and the internal end of the low pressure port 23 is opened at the inner peripheral surface of the cylinder body 2 as a suction port 20. The suction pipe 21 is connected to an accumulator 40 to let the refrigerant gas flow in.

Figure 4:
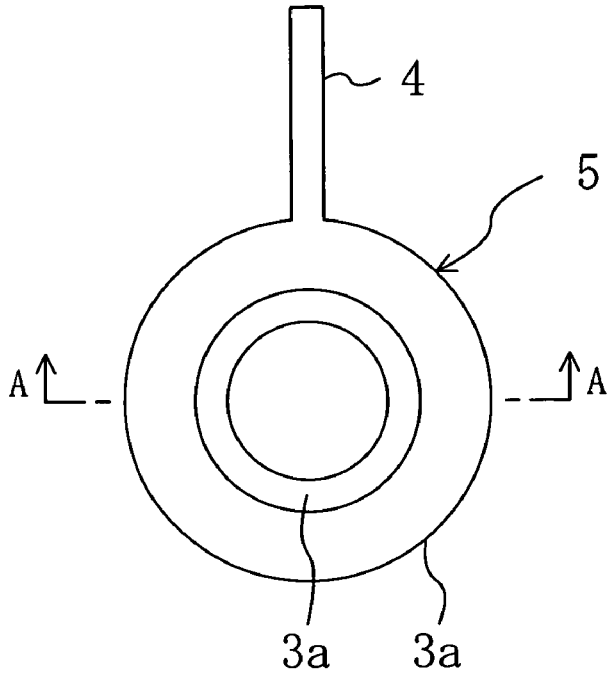
FIGS. 4A and 4B are views illustrating the piston according to Embodiment 1 of the present invention.
Figure 4:
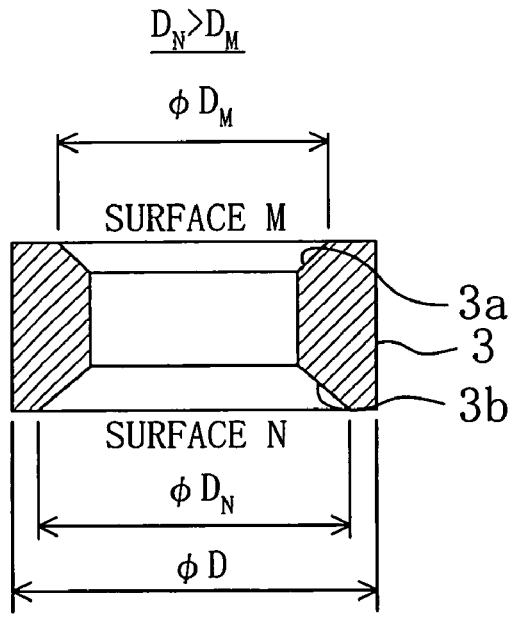

The roller 3 is in the cylinder form as described above. As schematically shown in FIGS. 4A and 4B, the inner peripheral edges at both ends of the roller 3 in the axis direction thereof are cut at a bevel to provide cut portions 3*a* and 3*b*. Specifically, the top and bottom end surfaces of the roller 3 slidably contacting the heads 7 and 8 are assumed as surface M and surface N, respectively. The top cut portion 3*a* sloped toward the surface M and the cut portion 3*b* sloped toward the surface N have substantially the same angle of inclination with respect to the surface M or N. The cut portions 3*a* and 3*b* are different in size, i.e., the height from the end surface and the width in the radius direction. As shown in FIG. 4B, the height of the bottom cut portion 3*b* from the surface N is larger than the height of the top cut portion 3*a* from the surface M and the width of the bottom cut portion 3*b* is larger than the width of the top cut portion 3*a*.

Assuming that the outer diameter of the surfaces M and N is D, the inner diameter of the surface M is $D_M$ and the inner diameter of the surface N is $D_N$, the width of the surface M, i.e., the width in the radius direction obtained by subtracting the inner diameter $D_M$ of the surface M from the outer diameter D of the surface M, is represented as $(D-D_M)/2$. Likewise, the width of the surface N, i.e., the width in the radius direction obtained by subtracting the inner diameter $D_N$ of the surface N from the outer diameter D of the surface N, is represented as $(D-D_N)/2$. Since the bottom cut portion 3*b* is formed larger than the top cut portion 3*a* as described above, the width of the surface M is larger than the width of the surface N. In other words, the inner diameter $D_M$ of the surface M is smaller than the inner diameter $D_N$ of the surface N.

The roller 3 is arranged such that the surface M having the larger width faces the bottom surface of the front head 7 having the high pressure port 10. Specifically, the top end surface of the roller 3 facing the high pressure port 10 has a larger width than the width of the other end surface (bottom end surface). However, unlike Embodiment 1, the roller 3 may be arranged such that the width of the bottom end surface has a larger width than the width of the top end surface.

The roller 3 made of a sintered alloy is obtained by pouring metal powder as a molding material into a mold (not shown), followed by pressing and sintering the metal powder. Specifically, the mold has a convex portion in the conical form at the bottom thereof for forming the beveled inner peripheral edge at the bottom end surface of the roller 3. Further, a pressing member (not shown) for pressing the molding material in the mold is provided with a convex portion for forming the beveled inner peripheral edge at the top end surface of the roller 3 and a cavity of the roller 3. The molding material poured into the mold is heated while it is pressed by the pressing member. In the mold, the roller 3 is formed with the bottom end surface facing the bottom of the mold. Thereafter, the molding material is released from the mold. In the molding of the roller 3, one of the end surfaces of the roller 3 pressed by the pressing member is given with a larger width, while the other end surface facing the bottom of the mold is given with a smaller width.

As shown in FIG. 1, the drive mechanism 1*b* is a motor and includes a stator 13, a rotor 12 and a crankshaft 14. The stator 13 is fixed to the airtight container 9. The rotor 12 is arranged inside the stator 13 in a rotatable manner and the crankshaft 14 is inserted into the rotor 12. The crankshaft 14 is integrated with an eccentric part 16. The roller 3 is fitted around the eccentric part 16 such that the roller 3 revolves. The drive mechanism 1*b* is not always limited to the motor.

An oil tube 18 for sucking refrigerator oil retained in an oil retainer 19 arranged at the bottom of the airtight container 9 is fixed to the bottom end of the crankshaft 14. An oil feeding path 15 for distributing sucked oil is formed in the crankshaft 14. The oil feeding path 15 is communicated with an oil feeding path outlet 17 which is opened at the eccentric part 16 or a bearing such that the refrigerator oil in the oil retainer 19 is guided to the sliding parts.

Now, an explanation of how the rotary compressor 1 of the present embodiment works will be provided.

The crankshaft 14 is driven by the drive mechanism 1*b* to rotate, thereby making the piston 5 swing within the cylinder body 2. As a result, refrigerant gas is sucked into the cylinder body 2 from the outside of the compressor 1 through the suction pipe 21. The piston 5 swings in the cylinder body 2 while the crankshaft 14 rotates. When the suction port 20 of the cylinder body 2 is closed by the outer peripheral surface of the roller 3, the step of sucking the refrigerant gas into the cylinder body 2 is finished. At this time, a compression chamber 22 is formed in the cylinder body 2. After the suction step, in the compression chamber 22, the process proceeds to a compression step as the piston 5 swings, and at the same time, another compression chamber 22 is formed near the suction port 20 and the refrigerant gas flows into the new compression chamber 22 in the same manner as described above.

As the crankshaft 14 rotates, the compression chamber 22 in the compression step decreases its volume, thereby gradually increasing the pressure in the cylinder body 2. When the pressure in the cylinder body 2 exceeds the pressure in the airtight container 9, i.e., the pressure around the compression mechanism 1*a*, the process proceeds to a discharge step. In the discharge step, the discharge valve begins to open due to the difference between the pressure in the airtight container 9 and the pressure in the compression chamber 22. Then, the refrigerant gas compressed in the compression chamber 22 begins to be discharged into the airtight container 9 through the high pressure port 10. As the crankshaft 14 further rotates, the difference in pressure increases and the discharge valve is lifted more, thereby discharging the compressed gas. Then, as the pressure difference between the airtight container 9 and the compression chamber 22 decreases, the discharge valve is lifted less. When the volume in the compression chamber 22 becomes minute, the discharge step is finished. The above-described series of steps are carried out by the rotation of the crankshaft 14. The refrigerant gas discharged from the compression chamber 22 is emitted out of the compressor mechanism 1*a*, temporarily retained in the airtight container 9, and then discharged out of the compressor 1.

Next, an explanation of oil flow will be provided. Refrigerator oil retained at the bottom of the compressor mechanism 1*a* flows upward within the crankshaft 14 due to the difference between the pressure at the oil feeding path outlet 17 formed in the crankshaft 14 and the pressure in the airtight container 9. Then, the oil flow is divided to supply the oil to the sliding parts, i.e., the rear head 8, eccentric part 16 and front head 7. Thus, a fine gap between the inner peripheral surface of the cylinder body 2 and the outer peripheral surface of the piston 5, a fine gap between the top end surface of the piston 5 and the bottom end surface of the front head 7 and a fine gap between the bottom end surface of the piston 5 and the top end surface of the rear head 8 are sealed with the oil.

Hence, in Embodiment 1, the following effects are achieved. In Embodiment 1, the roller 3 is arranged such that the end surface having a larger width (surface M) faces the bottom end surface of the front head 7. As described above, the high pressure port 10 is opened at the bottom end surface of the front head 7. Therefore, as compared with the structure in which the roller end surface having a smaller width faces the front head 7, it is possible to increase the diameter of the high pressure port 10 and arrange the high pressure port 10 closer to the center of the cylinder body 2, i.e., closer the crankshaft 14.

In general, the high pressure port 10 is always arranged to be more outside than the inner peripheral edge of the top end surface of the roller 3. In the rotary compressor 1 according to Embodiment 1, the roller 3 is arranged such that the end surface facing the high pressure port 10 (closer to the front head 7) has a larger width than the end surface facing the rear head 8. Accordingly, the inner diameter $D_M$ of the end surface closer to the front head 7 is smaller than the inner diameter $D_N$ of the end surface closer to the rear head 8. Therefore, even if the roller 3 is incorporated in the compressor 1 having a larger high pressure port 10, the space inside the roller 3 and the space outside the roller 3 are less likely to communicate with each other via the high pressure port 10.

Further, even if the thus configured roller 3 is incorporated in the compressor 1 having the high pressure port 10 which is positioned more inside, the space inside the roller 3 and the space outside the roller 3 are less likely to communicate with each other via the high pressure port 10.

Therefore, even if the roller 3 is shared, there is no need of taking measures of reducing the diameter of the high pressure port to avoid the communication. Accordingly, the diameter of the high pressure port is determined without limitations on the degree of freedom and a pressure loss by the high pressure port 10 is prevented from increasing.

Further, since there is no need of taking measures of shifting the high pressure port 10 outside to avoid the communication, the position the high pressure port is determined without limitations on the degree of freedom.

Still further, the portion of the compression chamber 22 lying outside the compression chamber 22 is reduced in area. Therefore, even if a recess is formed in part of the inner peripheral surface of the cylinder body 2 to ensure the effective area of the high pressure port 10, the recess is kept small and therefore dead volume which does not contribute to the compression is minimized.

Thus, according to the present invention, the degree of design freedom is ensured, the increase in pressure loss is prevented and the dead volume is prevented from increasing, thereby keeping the compression efficiency high.

According to Embodiment 1, the piston 5, i.e., the roller 3 and the blade 4 are made of a sintered alloy. The roller 3 made of the sintered alloy is obtained by pouring metal powder as molding material into a mold, followed by pressing and sintering the metal powder. In the molding of the roller, the top and bottom end surfaces are formed to have different widths to provide the end surfaces different areas. Therefore, the molding material is pressed stably by applying pressure from the end surface having a larger width (larger area). In this case, the molding material is easily released from the mold because the end surface having a smaller width (smaller area) is the side to be detached from the mold.

Embodiment 2

Figure 5:
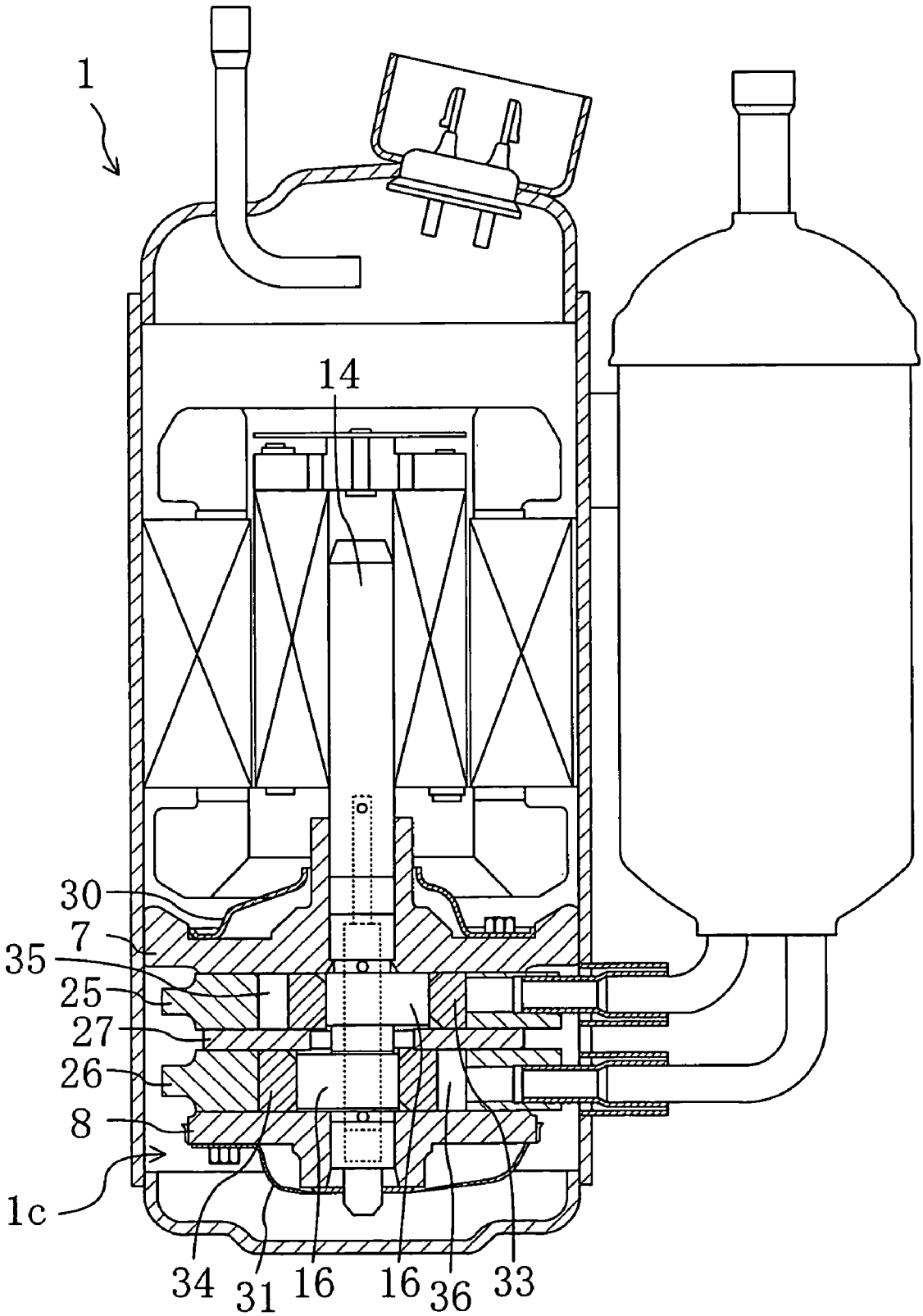
FIG. 5 is a view corresponding to FIG. 1 according to Embodiment 2 of the present invention.
Figure 6:
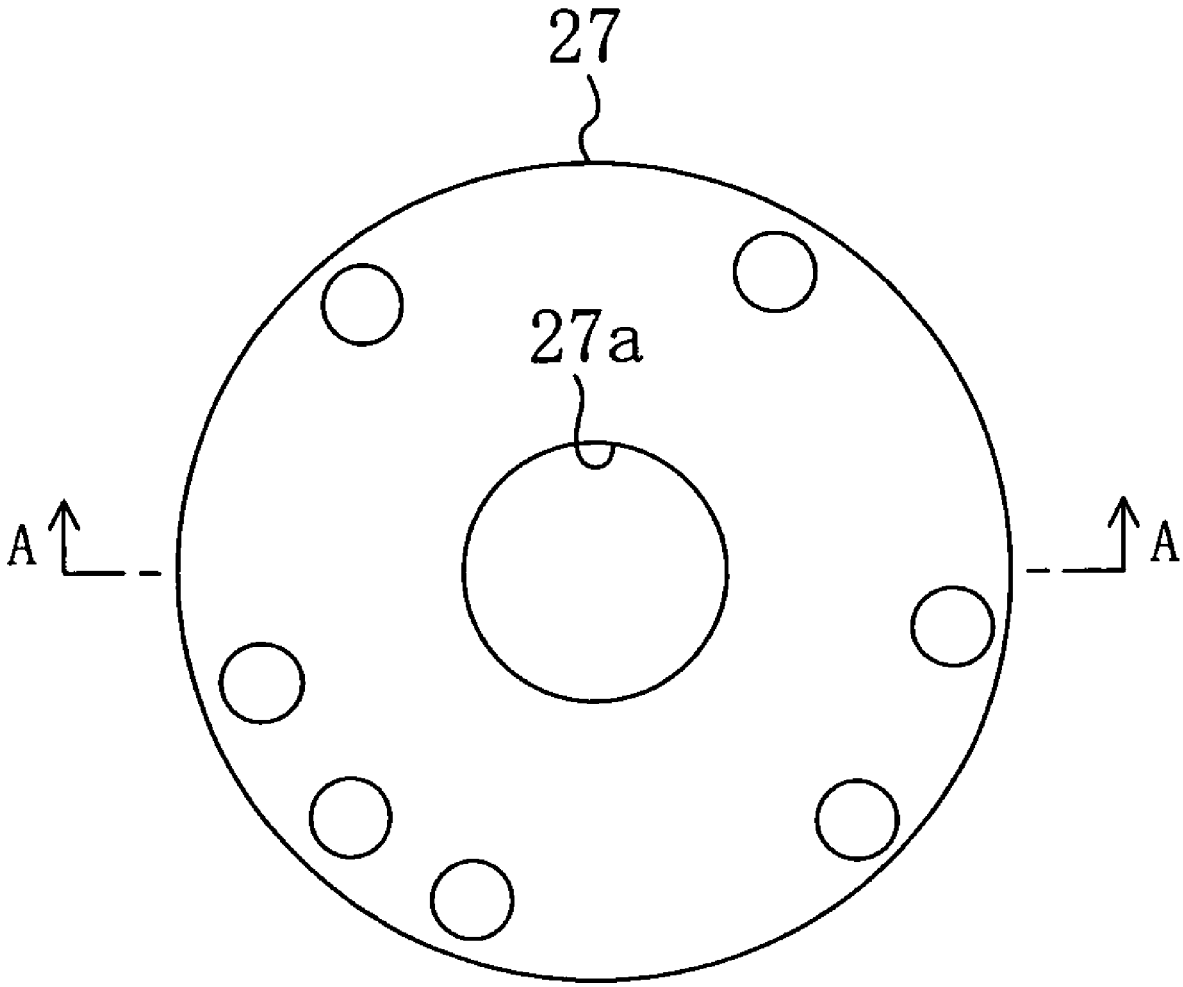
FIG. 6 is a plan view illustrating a middle plate.

FIG. 5 shows a rotary fluid machine according to Embodiment 2 of the present invention. In this figure, the same components as those of Embodiment 1 are indicated by the same reference numerals and a detailed explanation thereof is omitted. In Embodiment 2, the present invention is applied to a swing piston compressor 1 having two or more cylinder bodies 25 and 26.

A cylinder 1*c* of a compressor mechanism 1*a* includes two cylinder bodies 25 and 26 which are aligned in the direction of extension of a crankshaft 14, i.e., the vertical direction.

A front head 7 and a rear head 8 function as end plates, respectively. The front head 7 is arranged on the first cylinder body 25 above a second cylinder body 26 and the rear head 8 is arranged below the second cylinder body 26 below the first cylinder body 25. A middle plate 27 is arranged between the first cylinder body 25 and the second cylinder body 26 as a partition plate. In the center portion of the middle plate 27, a through hole 27*a* for passing the crankshaft 14 through is formed.

The front head 7, first cylinder body 25, middle plate 27, second cylinder body 26 and rear head 8 are arranged in this order and bolted together. The crankshaft 14 penetrates the heads 7 and 8, cylinder bodies 25 and 26 and middle plate 27.

A first piston 33 and a second piston 34 are arranged in the first and second cylinder bodies 25 and 26, respectively. The pistons 33 and 34 have the same structure as the piston 5 according to Embodiment 1. In Embodiment 2, the front head 7, first cylinder body 25, first piston 33 and middle plate 27 form a first compression chamber 35. Further, the rear head 8, second cylinder body 26, second piston 34 and middle plate 27 form a second compression chamber 36.

Figure 7:
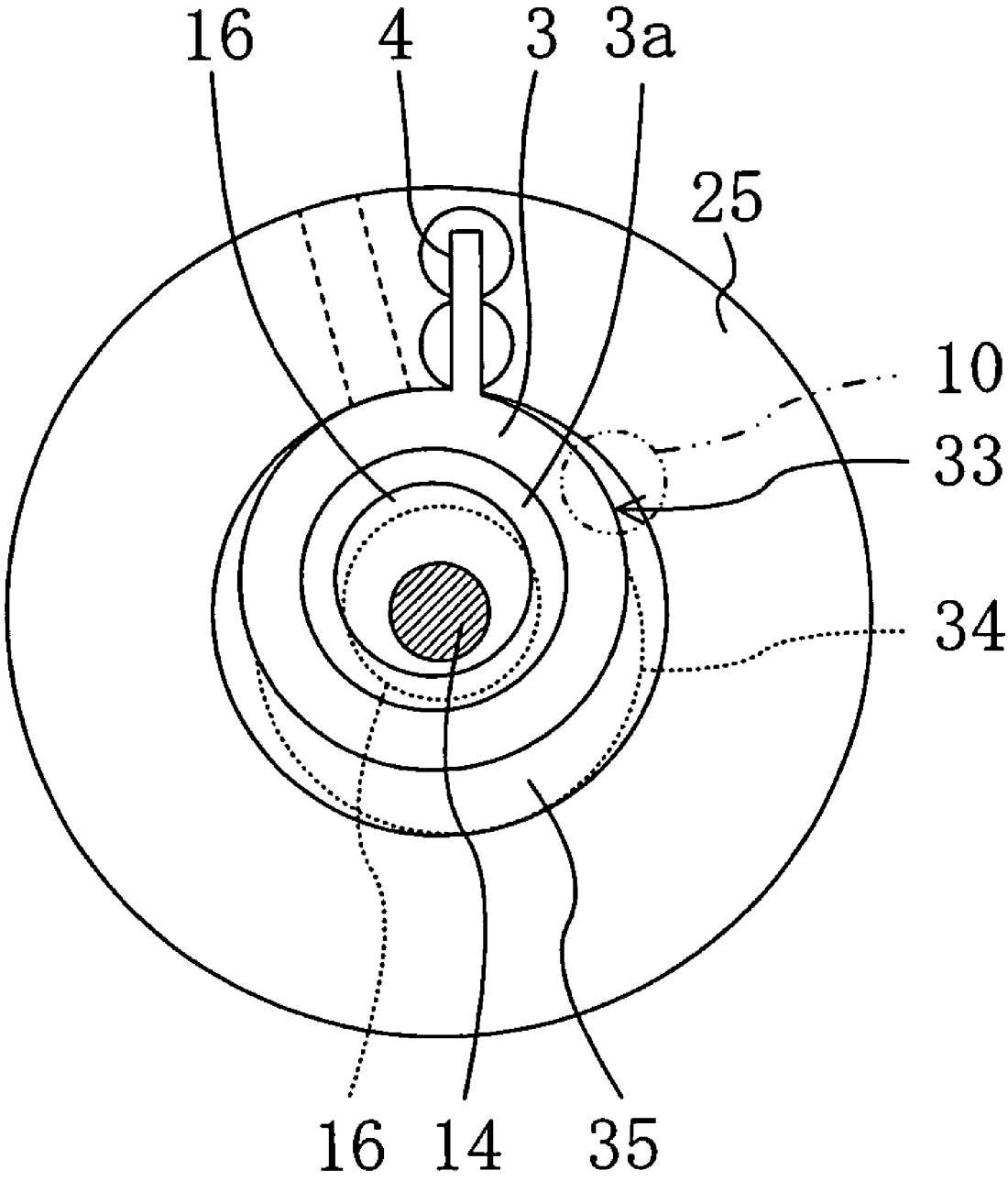
FIG. 7 is a view corresponding to FIG. 2 according to Embodiment 2 of the present invention.
Figure 8:
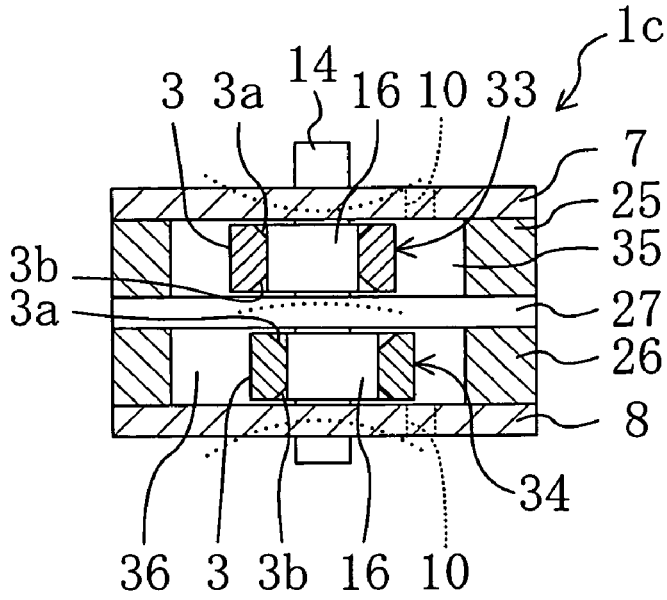
FIG. 8 is a view illustrating how a front head and a rear head deform.

The front head 7 and the rear head 8 are provided with high pressure ports 10, respectively, as shown in FIGS. 7 and 8. A top muffler 30 is attached to the front head 7 and a bottom muffler 31 is attached to the rear head 8.

A roller 3 of the first piston 33 is arranged such that the top end surface having a larger width faces the front head 7 and the bottom end surface having a smaller width faces the middle plate 27. Specifically, the roller 3 in the first cylinder body 25 is configured such that a cut portion 3*a* at the top end surface is smaller than a cut portion 3*b* at the bottom end surface. A roller 3 in the second piston 34 is arranged such that the bottom end surface having a larger width faces the rear head 8 and the top end surface having a smaller width faces the middle plate 27. Specifically, the roller in the second cylinder body 26 is configured such that a cut portion 3*b* at the bottom end surface is smaller than a cut portion 3*a* at the top end surface. In other words, the top and bottom rollers 3 are arranged such that the relationship between the widths of the top and bottom end surfaces (the sizes of the cut portions 3*a* and 3*b*) is opposite to each other.

The crankshaft 14 has two eccentric parts 16 corresponding to the number of the cylinder bodies 25 and 26. The eccentric parts 16 are arranged to have a difference in rotational phase of $\pi$ radian (180°) as shown in FIG. 7. The phase difference of $\pi$ radian makes it possible to cancel torque fluctuations caused by the compression of the refrigerant gas. FIG. 7 shows the first cylinder body 25 when the suction step has been finished. At this time, a first compression chamber 35 at a suction pressure is provided in the first cylinder body 25. In the second cylinder body 26, compression is carried out and a high pressure chamber at a discharge pressure and a low pressure chamber at a suction pressure are provided.

In the rotary fluid machine 1 according to Embodiment 2, the above-described series of steps including compression and discharge are carried out by the pistons 33 and 34 while the difference in rotational phase of $\pi$ radian is maintained. The refrigerant gas compressed in the first compression chamber 35 is discharged into the top muffler 30 through the high pressure port 10. The refrigerant gas compressed in the second compression chamber 36 is discharged into the bottom muffler 31 through the high pressure port 10 and then guided to the top muffler 30 through a discharge path which is not shown in the figure. The refrigerant gas in the top muffler 30 is temporarily retained in the airtight container 9 and then discharged out of the compressor 1.

In the state shown in FIG. 7, the first compression chamber 35 is at a suction pressure. In the second compression chamber 36, the high pressure chamber is at a discharge pressure, while the low pressure chamber is at a suction pressure. Therefore, different pressures are applied from above and below to the middle plate 27 between the top and bottom compression chambers 35 and 36, thereby elastically deforming the middle plate 27. As described above, however, the top and bottom rollers 3 are arranged such that the larger ones of their cut portions 3*a* and 3*b* face the middle plate 27. Therefore, even if the middle plate 27 is elastically deformed, the rollers 3 are less likely to be affected and operated smoothly.

To the front head 7, the discharge pressure in the airtight container 9 is applied from above and the suction pressure in the first compression chamber 35 is applied from below. Therefore, as shown in FIG. 8, the front head 7 is warped at the center toward the inside of the first cylinder body 25. Further, to the rear head 8, the discharge pressure in the airtight container 9 is applied from below and the pressure in the second compression chamber 36 is applied from above. Therefore, as shown in the same figure, the rear head 8 is warped at the center toward the inside of the second cylinder body 26.

Figure 9:
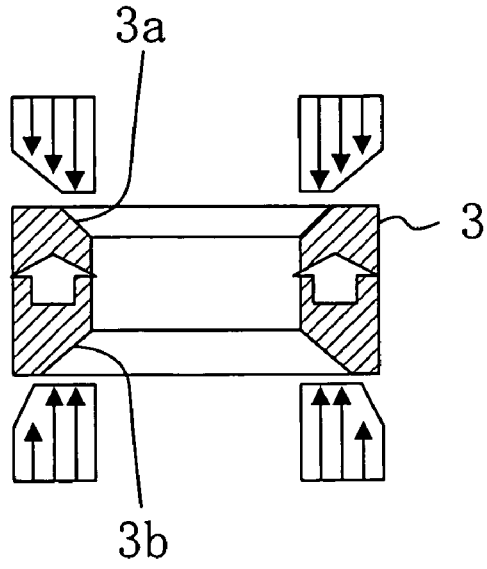
FIG. 9 is a view illustrating the distribution of hydraulic pressure applied to the roller.

As shown in FIG. 9, one of the end surfaces of each of the rollers 3 having the larger one of the cut portions 3*a* and 3*b* has a larger area for receiving hydraulic pressure than the other end surface having the smaller one of the cut portions 3*a* and 3*b*. Therefore, pressure is likely to be applied in the direction toward the smaller ones of the cut portions 3*a* and 3*b*. Therefore, in Embodiment 2, the roller 3 of the first cylinder body 25 is pressed upward and the roller 3 of the second piston 34 is pressed downward. As a result, the roller 3 of the first piston 33 suppresses the elastic deformation of the front head 7 caused by the above-described difference in pressure, while the roller 3 of the second piston 34 suppresses the elastic deformation of the rear head 8 due to the pressure difference. This makes it possible to suppress expansion of gaps between the rollers 3 and the heads 7 and 8. Thus, since the rollers 3 are arranged such that the larger ones of the cut portions 3*a* and 3*b* face the middle plate 27, the warp of the front and rear heads 7 and 8 caused by the discharge pressure in the airtight container 9 is suppressed. As a result, leakage of the refrigerant gas in the compression chambers 35 and 36 from the gaps between the rollers 3 and the heads 7 and 8 is suppressed.

Figure 10:
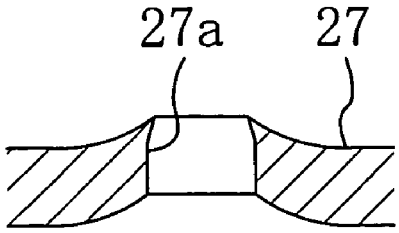
FIG. 10 is a view illustrating part of a section of the middle plate.
Figure 11:
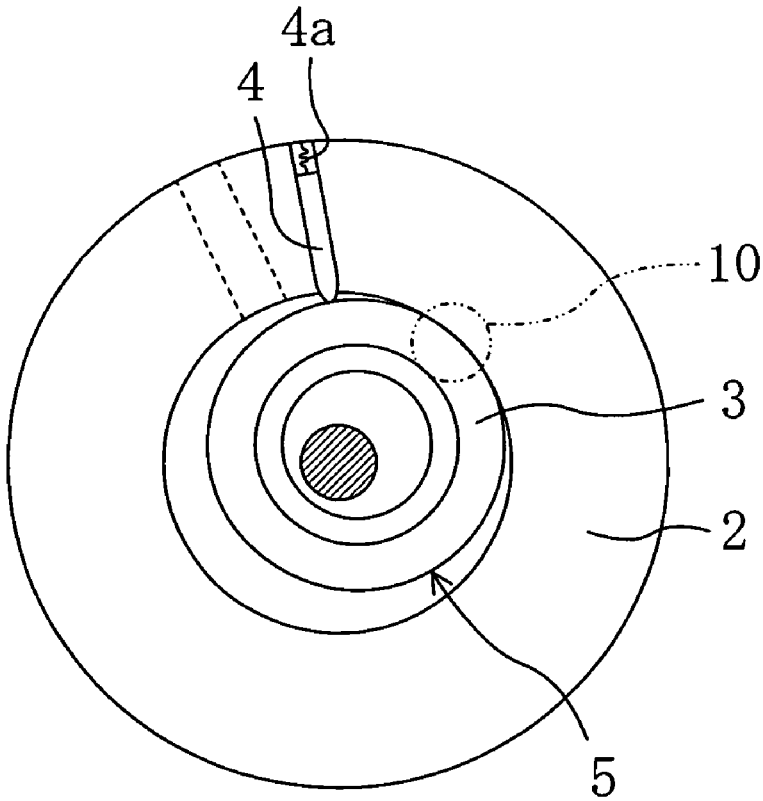
FIG. 11 is a view corresponding to FIG. 2 illustrating another embodiment.

When the through hole 27*a* is formed in the middle plate 27, the peripheral edge of the through hole 27*a* is likely to be slightly plastically deformed toward one side in the direction of penetration as shown in FIG. 10. However, since the rollers 3 are arranged such that the larger cut portions 3*a* and 3*b* face the middle plate 27 and the smaller cut portions 3*a* and 3*b* face the heads 7 and 8, the plastically deformed peripheral edge of the through hole 27*a* of the middle plate 27 is prevented from interfering with the roller 3. 5 Thus, the pistons 33 and 34 are operated more smoothly, thereby maintaining the compression efficiency high.

Other structures and effects are the same as those of Embodiment 1 described above.

Other Embodiments

In the above-described embodiments, the roller 3 and the blade 4 are integrated to provide the swing piston 5, 33 or 34. However, the integral piston may be replaced by a piston 5 which includes a separate roller 3 and blade 4. In this case, the blade 4 is pressed onto the roller 5 by a biasing means 4*a*. The roller 3 revolves along the inner peripheral surface of the cylinder body 2 and the blade 4 reciprocates in this state in response to the movement of the roller 3.

Figure 12:
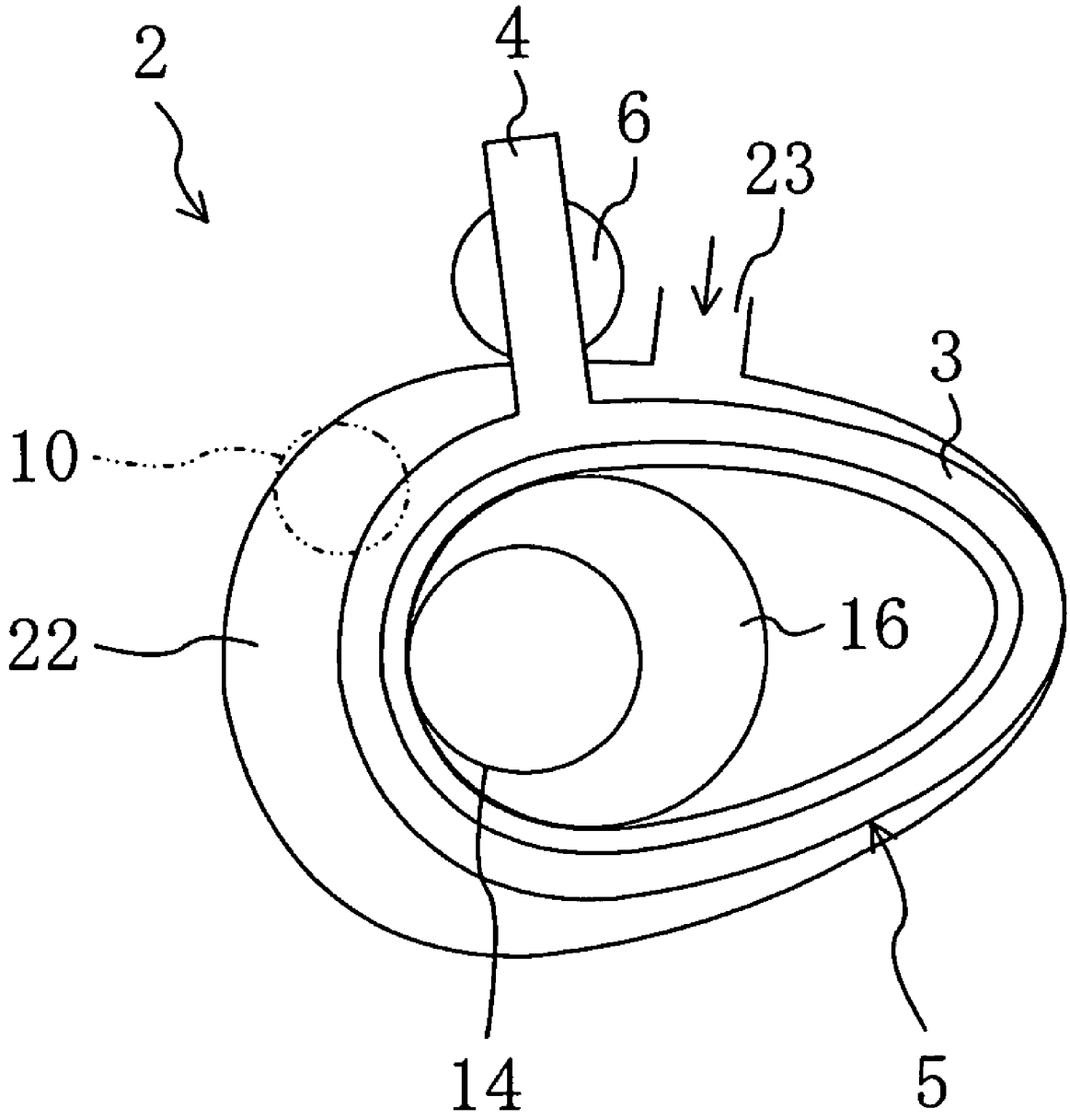
FIG. 12 is a view corresponding to FIG. 1 illustrating still another embodiment.
Figure 13:
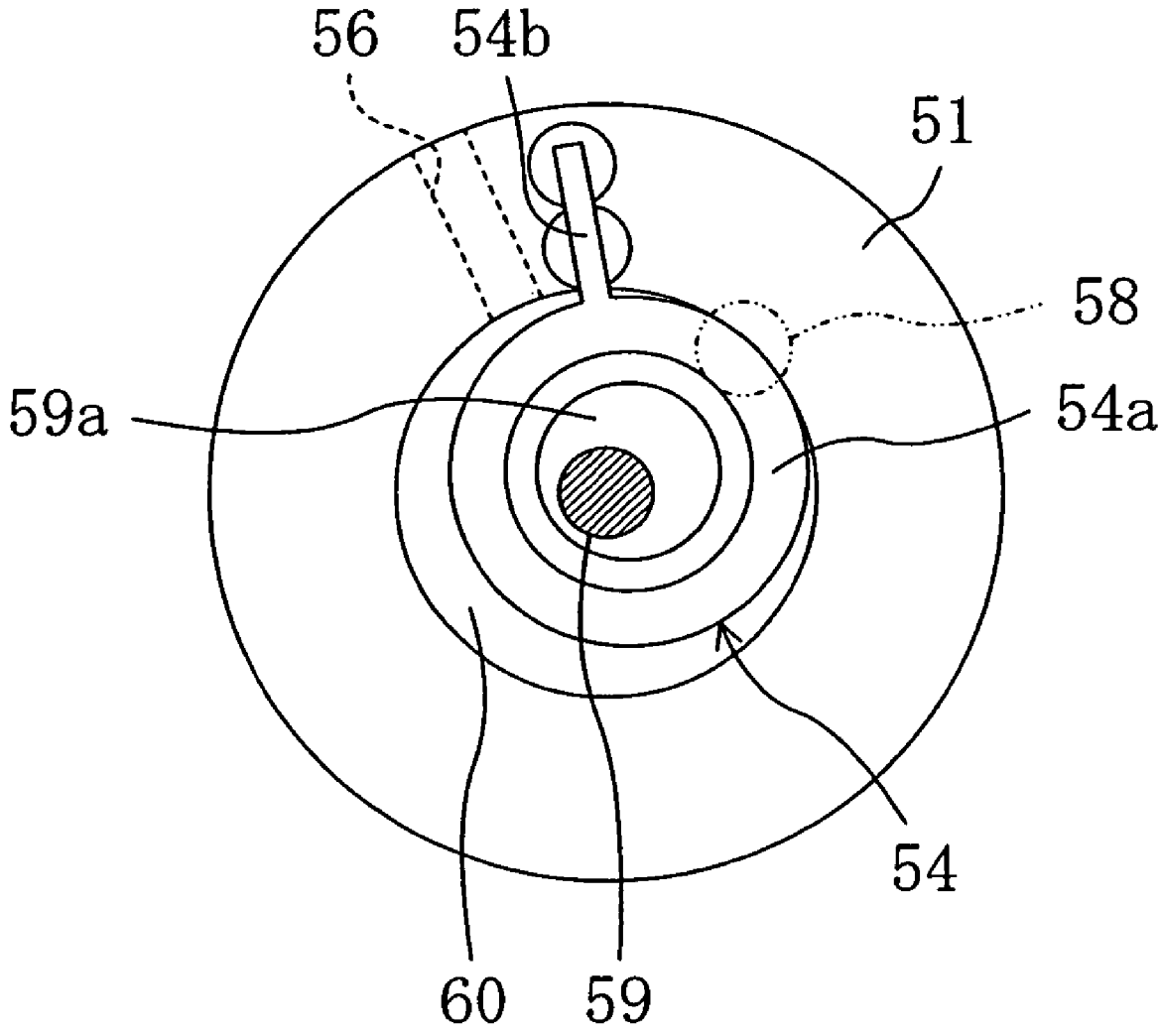
FIG. 13 is a view corresponding to FIG. 2 illustrating a conventional compressor.

In the above-described embodiments, the cylinder bodies 2, 25 and 26 and the rollers 3 are shaped to have circular sections, respectively. However, this is not limitative. For example, the cylinder body 2 and the roller 3 may be formed to have oval sections such as almost egg-shaped sections as shown in FIG. 12.

INDUSTRIAL APPLICABILITY

As described above, the rotary fluid machine according to the present invention is effective for enhancing efficiency. In particular, the present invention is suitable when the roller is shared.

What is claimed is:

1. A rotary fluid machine comprising:

a cylinder arranged in an airtight container and including first and second a cylinder bodies, first and second end plates arranged at first and second opposite end portions of the first and second cylinder bodies outside the first and second cylinder bodies, and a partition plate sandwiched between the first and second cylinder bodies, each of the first and second end plates having a high pressure port; and first and second roller portions disposed in the first and second cylinder bodies, respectively, the first and second roller portions including first and second cut portions, respectively, each of the first and second roller portions slidably contacting the partition plate and one of the first and second end plates, respectively, each of the first and second roller portions having an end surface facing a respective one of the first and second end plates that has a larger width than an opposite end surface disposed to face the partition plate with the partition plate having a central opening allowing fluid communication between the second cut portions of the opposite end surfaces of the first and second rollers through the partition plate, and a gas discharged through the high pressure ports being temporarily retained in the airtight container.

2. The rotary fluid machine according to claim 1, wherein each of the first and second roller portions is made of a sintered alloy.

3. The rotary fluid machine according to claim 1, wherein an inner peripheral edge of each opposite end surface of the first and second rollers is substantially aligned with or disposed radially outwardly of an inner peripheral edge of the central opening of the partition plate thoughout movement of the first and second rollers.

4. The rotary fluid machine according to claim 3, wherein each of the first and second roller portions is made of a sintered alloy.

* * * * *